US006863474B2

(12) United States Patent
Webster et al.

(10) Patent No.: US 6,863,474 B2
(45) Date of Patent: Mar. 8, 2005

(54) COMPRESSED GAS UTILIZATION SYSTEM AND METHOD WITH SUB-SEA GAS STORAGE

(75) Inventors: Brian Y. Webster, Houston, TX (US); Christopher D. Collins, Houston, TX (US); James A. Moody, Jr., League City, TX (US)

(73) Assignee: Dresser-Rand Company, Olean, NY (US)

( * ) Notice: Subject to any disclaimer, the term of this patent is extended or adjusted under 35 U.S.C. 154(b) by 0 days.

(21) Appl. No.: 10/403,943

(22) Filed: Mar. 31, 2003

(65) Prior Publication Data

US 2004/0191000 A1 Sep. 30, 2004

(51) Int. Cl.[7] ..... E02D 29/00
(52) U.S. Cl. ..... 405/210; 405/195.1
(58) Field of Search ..... 405/210, 195.1; 8/175.1

(56) References Cited

U.S. PATENT DOCUMENTS 3,113,699 A 12/1963 Crawford et al.
3,114,384 A 12/1963 Quase
3,643,447 A 2/1972 Pogonowski
3,851,487 A 12/1974 Lambertsen
4,289,425 A * 9/1981 Ootsu ..... 405/210
4,506,623 A 3/1985 Roper et al.
4,662,386 A 5/1987 Pedersen
4,692,249 A 9/1987 Hammel
4,710,100 A 12/1987 Laing et al.
4,873,828 A * 10/1989 Laing et al. ..... 405/210
5,050,680 A 9/1991 Diehl et al.
5,820,300 A 10/1998 Sonoda et al.
6,347,910 B1 * 2/2002 Morishige ..... 405/210

FOREIGN PATENT DOCUMENTS

JP 2-71053 * 3/1990 ..... 405/52

* cited by examiner

*Primary Examiner*—Frederick L. Lagman
(74) *Attorney, Agent, or Firm*—Michael Best & Friedrich LLP

(57) ABSTRACT

A system and method utilizing compressed gas according to which the gas is compressed at a location above ground and transported to an underwater location. The gas is stored at the underwater location and later returned from the underwater location to the above-ground location for utilization as energy.

22 Claims, 1 Drawing Sheet

COMPRESSED GAS UTILIZATION SYSTEM AND METHOD WITH SUB-SEA GAS STORAGE

BACKGROUND

This invention relates to a compressed gas utilization system and method and, more particularly, to such a system and method in which the compressed gas is stored in a sub-sea environment and later utilized as energy.

Compressed air energy storage (CAES) systems are generally known, and are for the purpose of storing energy, in the form of compressed gas, and later utilizing this stored potential energy for such purposes as the generation of electrical power. Typically, the CAES systems use electrical power purchased at low cost during off-peak periods to compress gas for storage. During periods of peak power demand, the potential energy in the stored gas is used to produce electrical power, which may be sole at a premium rate.

These systems can be used in a stand-alone mode for generating electrical power connected in a power grid, or they can be used with a conventional electrical power generating plant connected in a power grid, or the like. In the latter case, the power generated by the CAES system can be utilized as an adjunct to the power normally generated by the conventional power generating plant, usually during relatively high load conditions. CAES systems can also be used for balancing, optimizing, and enhancing the reliability of power grids and associated base-loaded power generating plants. Also, CAES systems can create spinning reserves or standby generating capacity, and can come on line in a relatively short time to take up a power load in the event a power generating plant on the grid malfunctions. Further, CAES systems can balance the power grid by taking and saving excess power, and can make up extra demand without a ramp up required by conventional power generating plants. Still further, CAES systems can improve the availability of renewable resource power by storing excess power and generating power when the renewable resource power is unavailable or inadequate.

A typical CAES system, or plant, includes a compression train in which a motor-driven compressor compresses a gas, such as air. The compressed gas is then transferred to, and stored at, a storage site, usually at a remote location, for later use at which time it is transferred back to an expansion side of the CAES plant. During the expansion cycle, the compressed gas is expanded through a conventional expansion train that may include high pressure and/or low pressure turbines that drive an electrical power generator to generate electrical power. In these arrangements, a fuel gas is often burned with the expanding gas to raise the temperature of the gas and improve the efficiency of the system However, known CAES plants utilize underground storage facilities for the compressed gas, along with piping systems to connect the storage facility to the compression and expansion sides of the CAES plant. This severely limits the site location due to the dependence on an acceptable geology for underground storage location. Also, the underground storage facility is usually located a considerable distance from the power generation or power consumption areas, resulting in transmission costs, losses and related expenses. Furthermore, underground storage facilities are susceptible to earthquake damage.

Therefore what is needed is a system of the above type for storing the gas that avoids the above problems. To this end, an embodiment of the present invention is directed to a sub-sea energy storage system which provides a significant improvement over the previous systems.

DETAILED DESCRIPTION

Figure 1:
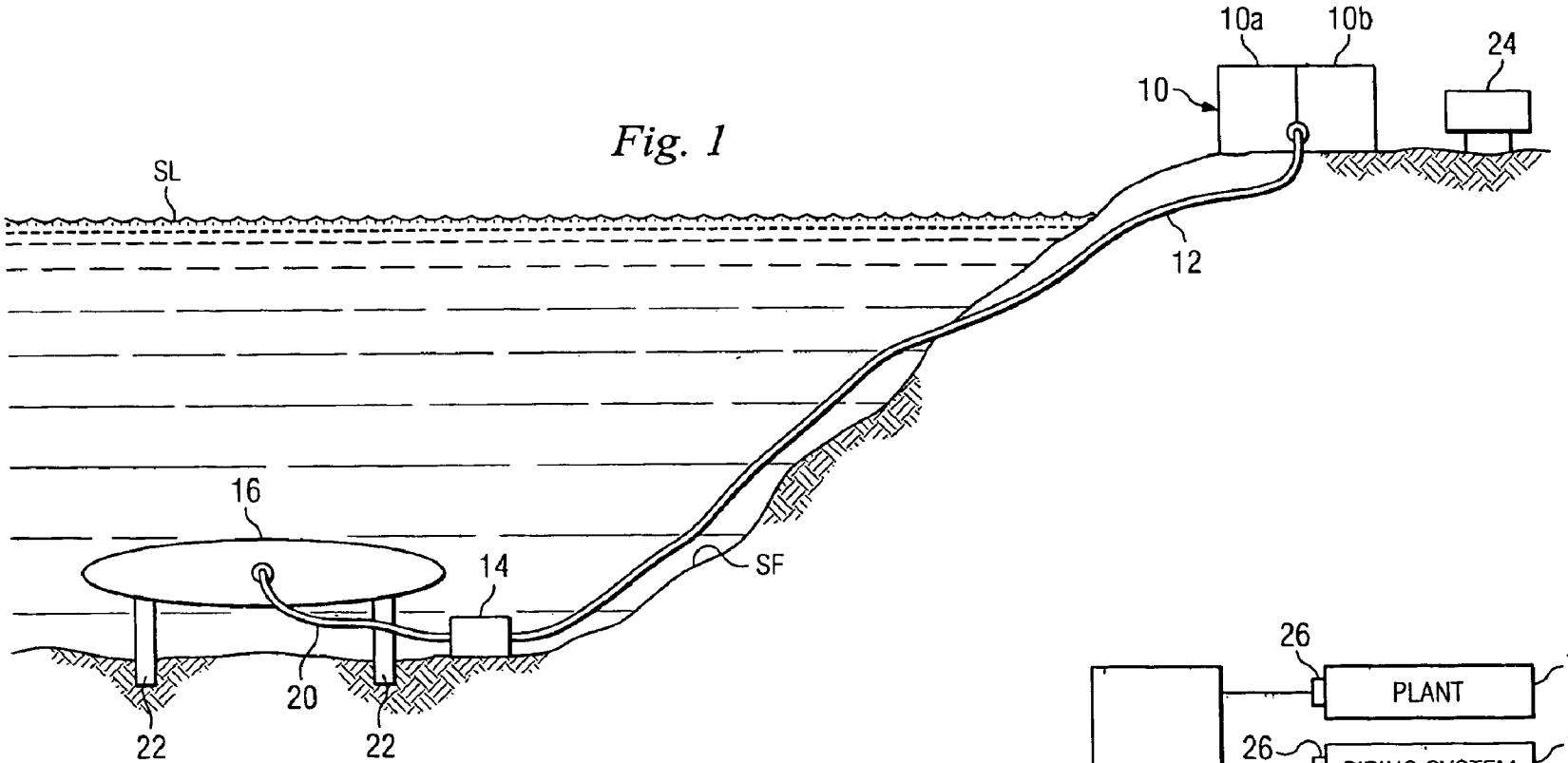
FIG. 1 is a diagrammatic view depicting the system of the present invention.

FIG. 1 depicts a system according to an embodiment of the invention which includes a plant 10 having a compression side 10*a* that includes a conventional motor-driven compression train and associated equipment (not shown) for compressing a gas, such as ambient air. The plant 10 also has an expansion side 10*b* in which the compressed gas is expanded through a conventional expansion train that includes high pressure and low pressure turbines that drive an electrical power generator to generate electrical power. It is understood that during operation of the expansion side 10*b* of the plant 10, the gas can be burned with fuel to improve the efficiency of the plant. Since the turbines, the compression and expansion trains, and the power generator are conventional they are not shown nor will they be described in further detail.

The plant 10 is located on the ground surface in the vicinity of a coastline near an adjacent water source such as a lake, sea, or ocean (hereinafter referred to as "sea") having a sea floor SF that drops off in height as it extends from the coastline. A piping system 12 is connected between the plant 10 and a manifold 14 resting underwater below the sea level SL on the sea floor SF, and at a distance from the coastline. It is understood that the piping system 12 includes at least one pipe that connects an outlet on the compression side 10*a* of the plant 10 to an inlet on the manifold 14, and at least one pipe that connects an outlet on the manifold to an inlet on the expansion side 10*b* of the plant. It can be appreciated that the piping system can include branch pipes, valves, etc. (not shown) to enable these connections to be made. The piping system 12 and the manifold 14 are commercially available devices commonly used in offshore piping systems for oil or gas applications.

A storage vessel 16 is mounted to the sea floor SF in the vicinity of the manifold 14. The vessel 16 is fabricated from a flexible material, such as a plastic, fabric, or similar material, that can collapse but does not stretch, and defines a fixed maximum closed volume. Although not shown in the drawings, it is understood that a suitable inlet and outlet are provided on the manifold 14 and the vessel 16 which can be controlled by valves in a conventional manner.

A conduit 20 connects the outlet of the manifold 14 to the inlet of the vessel as well as the outlet of the vessel to the inlet of the manifold so that the gas flow between the manifold and the vessel can be controlled. To this end it is understood that the conduit 20 can be provided with branch end portions and valving (not shown) to make the above connections. Although the vessel 16 is shown substantially cylindrical in shape with rounded ends, it is understood that this shape can vary, as will be discussed.

A mooring system 22 is provided that supports the vessel 16 slightly above the sea floor SF with the axis of the vessel extending substantially horizontally. The mooring system 22 is conventional and, as such, can, for example, be in the form of a piling system, an anchor system, a dead weight system, a combination of same, or the like.

When the flexible vessel 16 is inflated with the stored gas, and it is desired to release the gas from the vessel, the above-mentioned outlet valve associated with the vessel is opened and the hydrostatic pressure acting on the vessel causes a compression of the vessel to force the stored gas out from the vessel and into the conduit 20. The volume of the vessel 16 and the depth of the vessel below the sea level SL are determined so that this hydrostatic pressure acting on the vessel enables the gas to be discharged from the vessel at a substantially constant discharge pressure as the volume of the gas in the storage vessel decreases. In particular, the volume of the vessel 16 is determined by the combination of the depth of the vessel, the amount of electrical power to be generated by the plant 10, and the run time of the power generation cycle; while the depth of the vessel 16 is determined by the operating pressure of the plant and the volume of the vessel. The discharged gas passes through the conduit 20 and into the manifold 14 for return to the plant 10 via the piping system 12.

Although only one storage vessel 16 is shown in FIG. 1, it is understood that a plurality of vessels can be provided, in which case the manifold 14 would be connected to each vessel.

Figure 2:
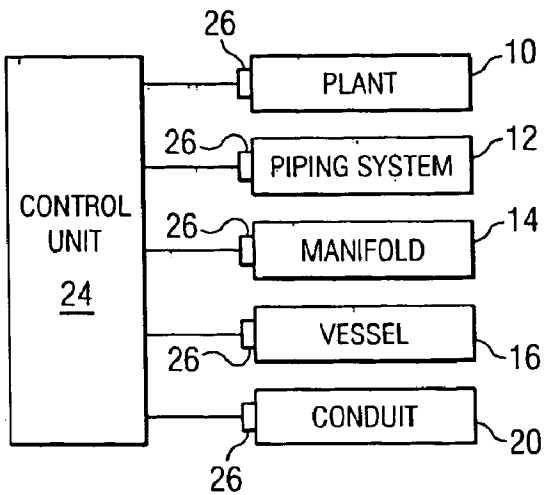
FIG. 2 is a diagrammatic view of the control/monitoring system for the system of FIG. 1.

A monitoring and control unit 24 is located on the ground surface and is adapted to monitor the conditions of the plant 10, the piping system 12, the conduit 20, the manifold 14, and/or the storage vessel 16, and control the operation of same. In particular, and referring to FIG. 2, the unit 24 is electrically connected to five sensors 26 which are associated with the plant 10, the piping system 12, the conduit 20, the manifold 14, and the vessel 16, respectively. The sensors 26 sense and monitor the volume, pressure and other parameters of the gas in the plant 10, the piping system 12, the conduit 20, the manifold 14, and/or the storage vessel 16 and send corresponding output signals to the unit 24. Also, it is understood that the above-mentioned valves can be operated in any conventional manner, and that the control unit 24 controls the operation of the valves to selectively control the flow of the gas through the piping system 12 from the compression side 10*a* of the plant 10 to the manifold 14, from the manifold to the vessel 16, from the vessel back to the manifold, and from the manifold to the expansion side 10*b* of the plant.

The unit 24 receives the signals from the sensors 26 and includes a microprocessor, or other computing device, to control the flow of the gas through the piping system 12 and the conduit 20 in the above manner. The unit 24 also can be adapted to monitor other parameters, such as the volume of gas stored in the vessel 16, the electrical power used to compress the gas in the plant, etc. Since this type of monitoring and control system is conventional, it will not be described in further detail.

In operation, the compression side 10*a* of the plant 10 receives a gas, such as air, and compresses it in the manner discussed above, before the gas flows to the manifold 14 via the piping system 12, under the control of the control unit 24. The manifold 14 directs the compressed gas into the storage vessel 16 at a flow rate that produces a pressure greater than the hydrostatic pressure exerted on the vessel. The vessel 16 is initially in a collapsed condition but inflates due to the presence of the compressed gas. This gas flow continues until tension is placed on the wall of the vessel, as measured by a strain gauge, or the like, which indicates that the vessel 16 is fully inflated at which time the gas flow is terminated so that there is minimum or no tensile stress on the vessel insuring that it will not be stretched.

When it is desired to release the gas from the vessel 16, the above-mentioned outlet valve associated with the vessel is opened and the hydrostatic pressure acting on the vessel causes a compression of the vessel to force the stored gas out from the vessel and into the conduit 20. The volume of the vessel 16 and the depth of the vessel below the sea level SL are determined in the manner discussed above so that the hydrostatic pressure acting on the vessel enables the gas to be discharged from the vessel at a substantially constant discharge pressure as the volume of the gas in the storage vessel decreases. The gas discharged from the vessel 16 passes via the conduit 20, the manifold 14, and the piping system to the expansion side 10*b* of the plant 10 for generating electrical power in the manner discussed above.

This system thus lends itself to the uses set forth above, including compressing and storing the gas during relatively low load conditions when the cost of electricity to compress the gas is relatively low, while permitting the stored compressed gas from the storage vessel 16 to be used in generating electricity during relatively high load conditions when the cost of the energy is relatively high. Also, due to the fact that the gas is discharged from the vessel 16 at a substantially constant discharge pressure as the volume of the gas in the vessel decreases, as described above, the efficiency is increased while the required overall storage volume is reduced. Further, the system enjoys a reduced susceptibility to earthquake damage and post-compression cooling of the gas due to the low temperature of the sea. This is all achieved while overcoming the drawbacks of the other underground storage facilities discussed above.

It is understood that variations may be made in the foregoing without departing from the scope of the invention. For example, the shape and orientation of the storage vessel 16 may be varied from that shown in the drawings as long as the pressure differential (or pressure swing) along the height (or diameter) of the vessel is limited so that a substantially constant discharge pressure is obtained during system operation, as discussed above. Also, a plurality of vessels 16 can be used, in which case the manifold 14 would be adapted to distribute the compressed gas to the vessels simultaneously or sequentially, and the operation would be the same as described above. Further, the manifold 14 can be eliminated and the gas transferred directly to the vessel 16, especially if only one vessel is used. Moreover, the gas stored in the vessel 16 can be utilized in manners other than the generation of electrical power.

It is also understood that when the expression "gas" is used in this application, it is intended to cover all types of gas, including air, natural gas, and the like. For example, natural gas can be stored in the above manner and utilized to provide fuel for burners on the expansion side 10*b* of the plant 10, as discussed above. Still further, it is understood that the piping system 12 and the conduit 20 can be used to transfer the compressed gas from the compression side 10*a* of the plant 10 to the manifold 14 and to the vessel 16, respectively, and another conduit and piping system can be used to transfer the stored gas from the vessel and the manifold, respectively, to the expansion side 10*b* of the plant.

Although only a few exemplary embodiments of this invention have been described in detail above, those skilled in the art will readily appreciate that many other modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents, but also equivalent structures.

What is claimed is:

1. A system for utilizing compressed gas, the system comprising a source of the compressed gas located on land, a storage vessel having an axis located substantially horizontally on a sea floor below sea level, a piping system connecting the source and the vessel so that the compressed gas can be transferred from the source to the vessel for storage, the storage vessel being flexible so that the hydrostatic pressure acting on the vessel can cause the compressed gas to discharge from the vessel at a substantially constant discharge pressure as the volume of the gas in the storage vessel decreases.

2. The system of claim 1 wherein the flexible storage vessel is collapsed before receiving the compressed gas and is at least partially inflated by the compressed gas.

3. The system of claim 2 wherein the gas flow into the storage vessel is limited so that there is no tensile stress on the storage vessel.

4. The system of claim 1 wherein there is a plurality of storage vessels, and further comprising a manifold for receiving the gas from the plant and distributing it to the storage vessels.

5. The system of claim 1 wherein the stored gas is transferred from the vessel through the piping system.

6. The system of claim 5 further comprising a control/monitoring system for monitoring the gas in the source, the piping system, and the storage vessel and for controlling the flow of the gas through the piping system accordingly.

7. The system of claim 5 further comprising an expander connected to the piping system for receiving the compressed gas and expanding the gas.

8. The system of claim 7 further comprising means for generating electrical power utilizing the expanded gas.

9. The system of claim 8 wherein the gas is compressed and stored during relatively low electrical power requirements.

10. The system of claim 8 further comprising an electrical power generating plant, and means for transferring the generated electrical power to the electrical power generating plant.

11. The system of claim 10 wherein the power generating plant is connected in a power grid and wherein the gas is compressed and stored when the consumption of electrical energy from the power grid is relatively low.

12. A method comprising compressing gas at a compressor located above ground, transporting the compressed gas to a flexible storage vessel located substantially horizontally below sea level, storing the gas in the storage vessel, utilizing hydrostatic pressure to discharge the compressed gas from the storage vessel, and returning the compressed gas to a ground location at a substantially constant discharge pressure as the volume of the gas in the storage vessel decreases.

13. The method of claim 12 wherein the storage vessel is collapsed before the step of storing, and is partially inflated by the compressed gas.

14. The method of claim 13 further comprising limiting the gas flow into the storage vessel so that there is no tensile stress on the storage vessel.

15. The method of claim 12 wherein there is a plurality of storage vessels, and further comprising receiving the compressed gas from the above-ground location and distributing the gas to the storage vessels.

16. The method of claim 12 further comprising connecting the compressor to the storage vessel by a piping system to permit the steps of transporting and returning.

17. The method of claim 16 further monitoring the gas in the compressor, the piping system and the storage vessel and controlling the flow of the gas through the piping system accordingly.

18. The method of claim 12 further comprising returning the gas from the storage vessel to an expander at the ground location, and expanding the gas in the expander.

19. The method of claim 18 further comprising generating electrical power utilizing the expanded gas.

20. The method of claim 19 wherein the steps of compressing and storing are done during relatively low electrical power requirements.

21. The method of claim 19 further comprising transferring the generated electrical power to an electrical power generating plant.

22. The method claim 21 wherein the power generating plant is connected in a power grid and wherein the steps of compressing and storing are when the consumption of electrical energy from the power grid is relatively low.

* * * * *